US005116265A

United States Patent [19]

Brown et al.

[11] Patent Number: 5,116,265

[45] Date of Patent: May 26, 1992

[54] SEPARABLE CONNECTOR MODULE WITH IMPROVED CURRENT-CARRYING THREADED JOINT

[75] Inventors: Thomas W. Brown, Hickory; Gerald W. Young, Conover, both of N.C.

[73] Assignee: General Electric Company, King of Prussia, Pa.

[21] Appl. No.: 699,436

[22] Filed: May 13, 1991

[51] Int. Cl.[5] ..... H01R 4/30

[52] U.S. Cl. ..... 439/801; 439/184; 439/921; 411/302

[58] Field of Search ..... 439/181, 183–187, 439/801, 805, 810, 921, 733, 737; 403/378, 320; 411/301–304

[56] References Cited

U.S. PATENT DOCUMENTS

| | | | |
|---|---|---|---|
| 3,550,668 | 12/1970 | Coyle | 411/302 |
| 4,170,394 | 10/1979 | Conway | 439/184 |
| 4,199,213 | 4/1980 | Tachick | 339/111 |
| 4,350,406 | 9/1982 | Goldbach | 339/111 |

FOREIGN PATENT DOCUMENTS

| | | | |
|---|---|---|---|
| 1431219 | 4/1976 | United Kingdom | 439/801 |
| 1444767 | 4/1986 | United Kingdom | 439/921 |

*Primary Examiner*—Paula A. Bradley

*Attorney, Agent, or Firm*—Henry J. Policinski; William Freedman

[57] ABSTRACT

This separable electrical connector module, which is movable through an operating stroke and is adapted to couple with a mating module, comprises: (a) a connector member including a copper portion containing a hole having a central longitudinal axis and internal threads surrounding the axis, and (b) a copper contact rod having one end that is externally threaded to provide external threads that mate with said internal threads and an opposite end adapted to engage a contact within the mating module. The external threads are restrained against rotation with respect to the mating internal threads by means comprising: (a) a passage in the connector member portion that intersects said internal threads in a predetermined location at one side of the central axis, and (b) a pin of plastic material tightly fitting within said passage and bearing against the external threads of the contact rod to provide a radial force on the contact rod that urges the external threads of the contact rod into high pressure engagement with the internal threads at the opposite side of the longitudinal axis from said predetermined location, thus maintaining a good electrical connection between the threads of the contact rod and the connector member despite repeated motion of the module through its operation stroke.

9 Claims, 2 Drawing Sheets

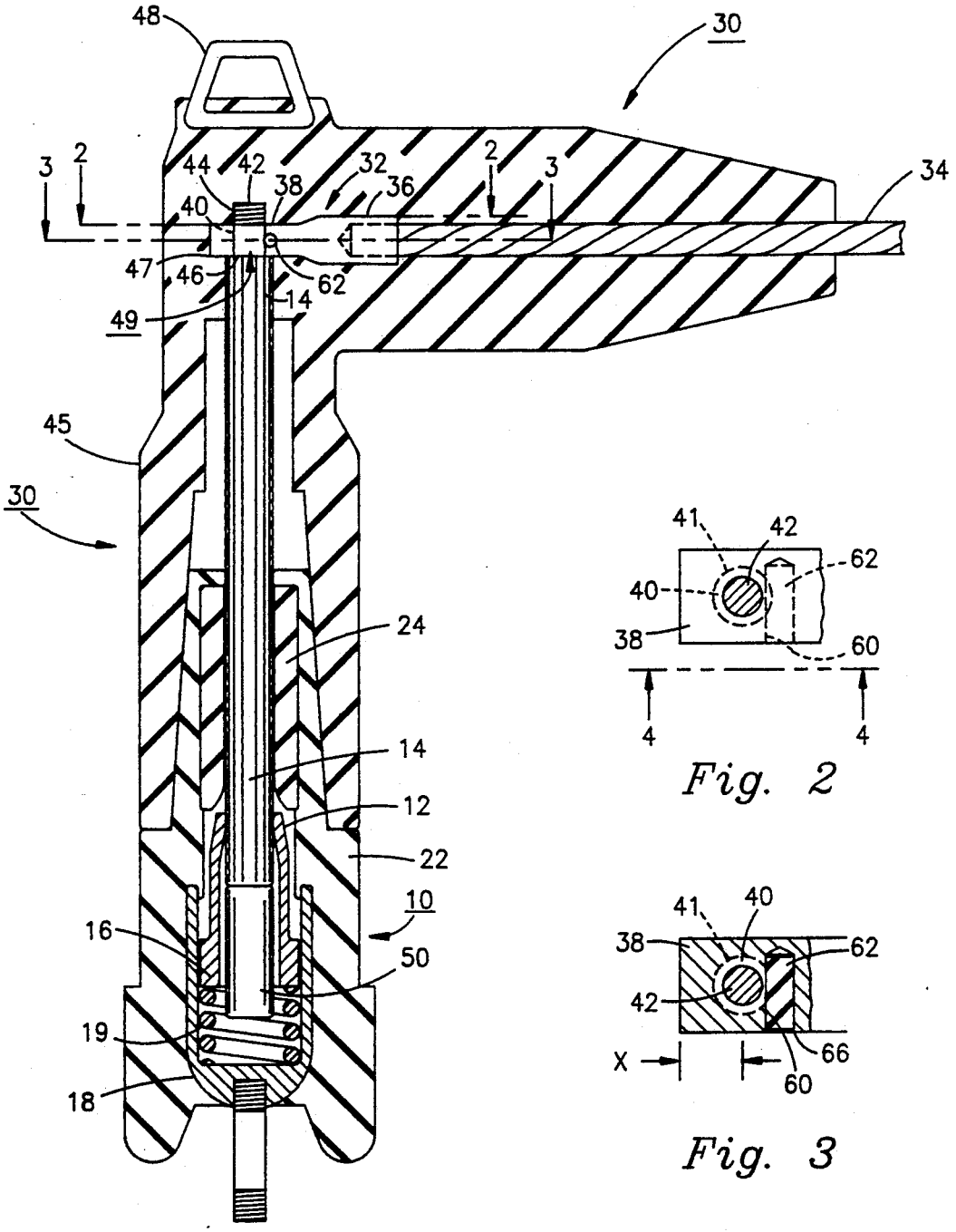
Fig. 1
Fig. 2
Fig. 3
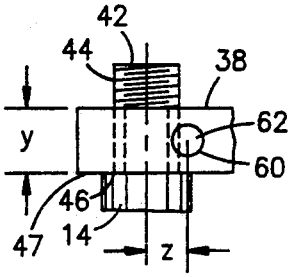
Fig. 4

SEPARABLE CONNECTOR MODULE WITH IMPROVED CURRENT-CARRYING THREADED JOINT

FIELD OF THE INVENTION

This invention relates to a separable electrical connector module that is adapted to couple with a mating connector module and, more particularly, relates to a connector module of this type that comprises a connector member, a contact rod, and a threaded joint for mechanically and electrically interconnecting the connector member and the contact rod.

BACKGROUND

A typical separable connector comprises a first module that is movable through an operating stroke and a stationary second module that is adapted to couple with the first module. The movable module typically takes the form of an elbow that comprises: (i) a conductive connector member that is connected by a crimp joint to an incoming cable and (ii) a contact rod that is joined to the connector member through a threaded joint. Typically, this threaded joint comprises external threads on one end of the contact rod and internal threads in a hole in the connector member that are adapted to mate with the external threads of the contact rod. This threaded joint serves to mechanically and electrically interconnect the connector member and the contact rod. Force applied to the connector member is used for driving the contact rod into and out of engagement with mating contacts in the stationary module. When the mating contacts are engaged or are being operated into or out of engagement, current flows through the threaded joint, developing thermal and magnetic conditions therein that must be successfully withstood without deterioration of the joint. Also, the mechanical stresses developed by connector operation must be sucessfully withstood without deterioration of the joint. A low resistance connection must be maintained at this threaded joint to avoid overheating.

Maintaining a low resistance connection at this joint has proven to be a difficult problem. One approach to overcoming this problem has been to use one or more spring washers between the contact rod and connector to maintain axial tension on the threads of the contact rod. Because of space limitations these washers cannot be very large, and the washers that have been used have been found not very effective in preventing the threads from eventually loosening as a result of vibrations or of strains produced by operating forces.

Another approach that has been considered is to use thread-locking techniques that involve distortion of the mating metallic threads prior to assembly. A disadvantage of this approach is that a typical amount of thread distortion produces an excessively wide range of assembly torques. Low assembly torque would be associated with insufficient thread locking. High assembly torque would likely result in the incomplete installation of the contact rod. Variations in material and dimensions can significantly affect the amount of torque that is appropriate.

Still another approach that we have considered is to use a plastic insert around the full circumference of the internally threaded member. This seems to be not as effective as might be desired because the plastic insert tends to keep the externally threaded contact rod centered, thus inhibiting good high pressure engagement between the mating threads.

OBJECTS

An object of our invention is to provide, for a movable separable connector module, a threaded joint between the contact rod and a connector member that provides a reliable electrical and mechanical connection that retains a low electrical resistance despite prolonged service and many opening and closing operations of the module.

Another object is to fulfill the preceding object without the need for relying upon spring washers or similar devices for exerting a tensile force on the components of the threaded joint.

Another object is fulfill the first object without relying upon thread-locking means that tends to keep the threaded components centered relative to each other.

Still another object is to fulfill the first object by compact means that consumes only the normally available space in the separable connector module without requiring major design change and a long-term phase-in program.

SUMMARY

In carrying out our invention in one form, we provide a separable electrical connector module that is movable through an operating stroke and is adapted to couple with a mating module. The movable module comprises: (a) a connector member comprising a copper portion containing a hole having a central longitudinal axis and internal threads surrounding the axis, and (b) a copper contact rod having one end that is externally threaded to provide external threads that mate with said internal threads and an opposite end adapted to engage a contact within the mating module. The external threads are restrained against rotation with respect to the mating internal threads by means comprising: (a) a passage in the connector member portion that intersects said internal threads in a predetermined location at one side of the central axis, and (b) a pin of plastic material tightly fitting within said passage and bearing against the external threads of the contact rod to provide a radial force on the contact rod that urges the external threads of the contact rod into high pressure engagement with the internal threads at the opposite side of the longitudinal axis from said predetermined location, thus maintaining a good electrical connection between the threads of the contact rod and the connector member despite repeated motion of the module through its operation stroke.

BRIEF DESCRIPTION OF FIGURES

For a better understanding of the invention, reference may be had to the following detailed description taken in conjunction with the accompanying drawings, wherein:

FIG. 1 is a simplified sectional view showing a separable connector comprising two connector modules, one being a movable module that embodies one form of our invention.

FIG. 2 is a sectional view along the line 2—2 of FIG. 1.

FIG. 3 is sectional view along the lines 3—3 of FIG. 1.

FIG. 4 is a side elevational view of the structure of FIG. 2 as viewed from the line 4—4 of FIG. 2.

DETAILED DESCRIPTION OF EMBODIMENTS

Figure 5:
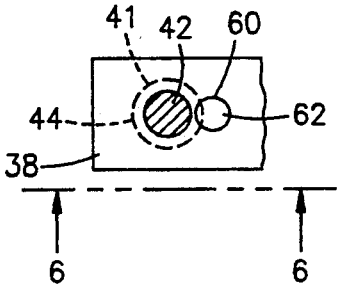
FIG. 5 is a sectional view of a modified form of the invention taken along a line corresponding to 2—2 in FIG. 1.

Referring now to FIG. 1, the separable connector shown therein comprises a stationary connector module 10 comprising contacts 12 forming a socket for receiving a movable contact rod 14. In the embodiment illustrated in FIG. 1, socket contacts 12 are mounted on a piston 16 which is slidable within a stationary metal container 18 and is biased upwardly by a compression spring 19 beneath the piston. The piston makes electrical contact with the inner cylindrical wall of the container 18 along the outer periphery of the piston. This piston and container structure is disclosed in more detail and claimed in U.S. Pat. No. 4,350,406-Goldbach, assigned to the assignee of the present invention.

The stationary module further comprises a weatherproof jacket 22 surrounding the socket contacts 12, piston 16 and container 18. This jacket 22, which is of a conventional design, is primarily of elastomeric electrical insulating material but includes an elastomeric semiconducting outer coating for controlling electrical stresses. The details of the shield form no part of the present invention and are not illustrated. Mounted within this jacket just above the socket contacts 12 is a snuffer sleeve 24 made of a plastic material from which gas is released when the sleeve is exposed to an electric arc, as during an opening or closing operation of the connector.

Since the stationary connector module 10 is of a conventional design, its details are disclosed herein only generally. Reference may be had to the aforesaid Goldbach patent or to U.S. Pat. No. 4,175,817-Tachick for a more specific disclosure. These two patents are incorporated by reference in the present application.

Mating with the stationary connector module 10 is a movable connector module 30 in the form of an elbow. This elbow comprises a connector member 32 that is electrically connected to an incoming cable 34. More specifically, the connector member 32 comprises a first portion 36 that includes a socket for receiving one end of the cable 34. The socket is crimped about the cable end to form a good electrical connection with the cable end.

The connector member 32 further comprises a second portion 38 that is joined to the first portion 36 by a suitable weld. In one form of the invention, portion 36 is of aluminum, portion 38 is of copper, and the weld is a copper-to-aluminum weld of the inertia-weld type. The front part of connector portion 38 has the shape of a flattened rod and has an internally threaded hole 40 extending transversely therethrough. Referring to FIGS. 2-4, the internal threads of hole 40 are designated 41. The upper end 42 of the contact rod 14 has external threads 44 that mate with the internal threads 41 of the hole 40. Contact rod 14 is preferably of copper so that the mating threads are all of copper, thereby providing a high degree of electrical conductivity.

The upper threaded end of the contact rod 14 is of a slightly smaller diameter than the body of the contact rod so that there is a shoulder 46 between the upper threaded end and the body. When the contact rod 14 is being installed, its upper end is threaded into the threaded hole 40 until this shoulder 46 engages the lower surface 47 of the connector portion 38. If this installation is to be made in the field, the installer is instructed to thread the upper end into the hole 40 until the shoulder 46 engages surface 47 and then to apply further tightening torque with a special disposable wrench until the wrench bends or develops a permanent deformation. In this way the tightening torque applied by the installer is appropriately controlled.

The movable connector, or elbow, further comprises a weather-proof L-shaped jacket 45 surrounding the connector member 32 and the contact rod 14. This jacket 45, which is of a conventional design, is primarily of elastomeric electrical insulating material but includes an elastomeric semiconducting coating on its outer surface and an elastomeric semiconducting shield on a portion of its inner surface for controlling electrical stresses. The details of the shields form no part of the present invention. A hot-stick operating eye 48 of stainless steel or other suitable material is incorporated into this jacket and is adapted to receive a hot stick tool (not shown). This tool can be operated in a conventional manner to actuate the movable elbow 30. Upward motion of the hot stick lifts the elbow 30, carrying the movable contact rod 14 upwardly and out of engagement with the stationary contacts 12, thereby opening the circuit through the separable connector. After such opening, opposite, or downward, motion of the hot stick carries the elbow downwardly, driving the movable contact rod 14 back into engagement with the contacts 12, thereby closing the circuit. To assist in closing against a fault, a follower 50 of plastic material is carried by the lower end of the contact rod. When the movable contact rod 14 nears the stationary contacts 12 during a closing operation, an arc is developed between the contacts 12 and 14, and this arc reacts with the plastic snuffer 24 and follower 50 to develop gases that act on the piston 16 to assist in the closing operation, all in a conventional manner.

While FIG. 1 shows our invention embodied in a connector of the load-break type, it is to be understood that the invention is also applicable to dead-break and non-loadbreak connectors. In such connectors, there is typically a socket contact corresponding to the illustrated contact 12, but stationarily mounted, rather that being mounted on a piston, such as the piston 16 shown. An elbow corresponding to the illustrated elbow 30 is typically present in such connectors. The follower 50 is typically omitted in such connectors.

As pointed out in the introductory portion of this specification, a problem that has often been encountered in separable connectors of the above-described types is overheating of the threaded joint 49 between the contact rod 14 and the connector member. Unless the threads of this joint are tightened to a carefully controlled degree and are maintained in such condition, the desired low resistance of the joint will sometimes be lost and overheating will occur.

We reduce the chances for such overheating by providing thread-locking means that in the embodiment of FIGS. 1-4 comprises: (i) a passage 60 that extends perpendicular to the axis of the threaded hole 40 and intersects the internal threads 41 of the hole and (ii) a plastic pin 62 tightly fitted within this passage 60. Pin 62 is of a Nylon, a polyethylene, an acetal, or similar plastic. During an assembly operation, when the externally-threaded upper end 42 of the contact rod is threaded into hole 40, the already-positioned plastic pin 62 engages the external threads 44 of the contact rod and develops a radial force on the upper end of the contact rod that urges the external threads 44 into relatively high pressure engagement with the internal threads 41 at the opposite side of the contact rod end.

The radial force developed by the plastic pin 62 and the resulting high pressure engagement of the threads at the opposite side of the contact rod end assure that low-resistance electrical contact is made at said opposite side and, further, that such contact is maintained during the normal life of the separable connector or until the movable contact rod is deliberately unscrewed for removal. This radial force and high pressure engagement also assure that there will be no undesired loosening of the threads as a result of vibrations or as a result of repetitive operating forces applied to the elbow.

As previously mentioned, when the contact rod 14 is installed, its upper end 42 is threaded into the hole 40 until the shoulder 46 engages the lower surface 47 of the connector member. The plastic pin 62 is already present when this operation takes place. As a result, the external threads 44 on the contact rod dig into the plastic pin and thus assure that the desired engagement is made between these external threads and the plastic pin. The plastic pin 62 may be intact just prior to such installation of the contact rod, or it may have been partially cut by another screw (of slightly smaller diameter than the upper end 42 of the contact rod) threaded into the hole 40 prior to installation of the contact rod and then removed. This partial precutting of the plastic pin 62 facilitates subsequent threading of the contact rod into the hole. After the shoulder 46 has engaged the lower surface 47 of the connector member, a prescribed amount of additional tightening torque is applied.

Our studies of separable connector systems of the general type here involved indicate that opening and closing operations of the elbow tend to apply to the contact rod 14 and the connector 32 a force which is slightly off-axis with respect to the central longitudinal axis of the contact rod 14. This off-axis force tends to stretch the threaded contact rod end, and such stretching appears to have been responsible for thread-loosening in certain prior designs of this elbow, including those which use a spring washer between the shoulder 46 and surface 47, as well as those which do not. But with our thread-locking means, even though some slight stretching of the above type might occur, our thread-locking means continues to exert the desired radial force on the contact rod end to hold the threads in high pressure engagement at one side of the contact rod end.

The connector member 32 is required to be of fairly standardized size. This leaves little room for the incorporation of thread-locking means. We overcome this problem by locating our passage 60 for the plastic pin 62 on the inner side of the threaded hole 40, where such passage can be accommodated without consuming otherwise needed space and without significantly weakening the structure of the connector member. By "inner side", we mean the side of the hole 40 between the hole 40 and the crimped portion 36 of the connector member.

In one embodiment of our invention, we hold the plastic pin 62 in place within passage 60 by peening over the surrounding copper at the outer end of the passage, as shown at 66 in FIG. 3. In another embodiment, we employ a plastic pin 62 that has an interference fit with the passage 60. This plastic pin is driven into the passage 60, and the friction from the interference fit anchors the pin in place.

In one specific embodiment of our invention, the hole 40 has a ⅜ inch diameter and No. 16 internal threads. The dimension x of FIG. 3 is about 0.275 inches; the dimension y of FIG. 4 is about 0.45 inches; and the dimension z of FIG. 4 is about 0.21 inches. The diameter of passage 60 is about 0.14 inches and the length of the passage 60 is about 0.55 inches. These dimensions are given strictly by way of example and not limitation.

Figure 6:
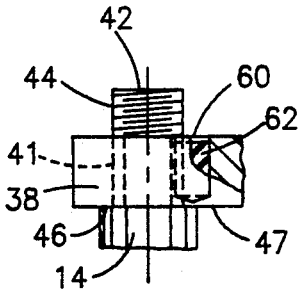
FIG. 6 is side elevational view of the structure of FIG. 5 as viewed from the line 6—6 of FIG. 5.

FIG. 5 and 6 show another embodiment of the invention that utilizes a plastic pin such as 62 for locking the external threads 44 of the contact rod against rotation with respect to the internal threads 41 of the connector portion 38. In this embodiment, there is a passage 60 that extends parallel to the axis of the contact rod 14 rather than traversely thereto, as in the first embodiment. As shown in FIG. 5, passage 60 receives a pin 62 of circular cross-section that extends inwardly into the bore of threaded hole 40 before the threaded upper end 42 of the contact rod is threaded into the hole 40. During an assembly operation, when the externally-threaded upper end 42 of the contact rod is threaded into hole 40, the already-positioned plastic pin 62 engages the external threads 44 of the contact rod and develops a radial force on the upper end of the contact rod that urges the external threads 44 into relatively high pressure engagement with the internal threads 41 at the opposite side of the contact rod end. During such assembly, the external threads 44 on the contact rod dig into the plastic pin and thus assure that the desired engagement is made between these external threads and the plastic pin. After the shoulder 46 on the contact rod engages the lower surface 47 of the connector member, a prescribed amount of additional tightening torque is applied.

As in the first embodiment, pin 62 is held in place within passage 60 either by peening over connector material at the outer end of passage 60, or by using an interference fit between pin 62 and passage 60, or by using both of these techniques. Also, as in the first embodiment, the passage 60 for the plastic pin 62 is located on the inner side of the threaded hole 40, where such passage can be accommodated without significantly weakening the structure of the connector member.

Another noteworthy feature of our threaded joint is that the upper end of the contact rod 14 can be threaded into either end of the threaded hole 40 in the connector member 32. This is advantageous from a field-installation point of view since a lineman may have inadvertently installed the connector member in an inverted position from that illustrated. With our joint, this inversion does not interfere with his continuing the installation operation by threading the contact rod into the hole 40 in the connector member and achieving the desired high reliability electrical and mechanical connection.

While we have shown and described particular embodiments of our invention, it will be obvious to those skilled in the art that various changes and modifications may be made without departing from our invention in its broader aspects; and we, therefore, intend herein to cover all such changes and modifications as fall within the true spirit and scope of our invention.

What we claim as new and desire to secure by Letters Patent of the United States is:

1. A separable electrical connector module movable through an operating stroke and adapted to couple with a mating connector module, comprising:

(a) a connector member comprising a copper portion containing a hole having a central longitudinal axis and internal threads surrounding said axis, (b) a copper contact rod having one end that is externally threaded to provide external threads that mate with said internal threads to form a current-carrying threaded joint between said contact rod and said connector member and an opposite end adapted to engage a contact within said mating module, and (c) means for enhancing the current-carrying capabilities of said threaded joint and for restraining said external threads against rotation with respect to said internal threads comprising:

a passage in said connector member portion that intersects said internal threads in a predetermined location at one side of said central longitudinal axis, and a pin of plastic material tightly fitting within said passage and bearing against the external threads of said contact rod to provide a radial force on said contact rod that urges the external threads of said contact rod into high pressure engagement with said internal threads at the opposite side of said longitudinal axis from said predetermined location, thus maintaining a good electrical connection between the threads of said contact rod and said connector member despite repeated motion of said movable separable connector module through its operating stroke, and in which:

(d) said contact rod includes a shoulder adjacent said externally-threaded one end, (e) said shoulder bears against a surface of said connector member when said contact rod is in its normal position with respect to said connector member, and (f) repeated motion of said movable module through its operating stroke causes a slight stretching of said threaded one end of the contact rod that tends to separate said shoulder from said surface of the connector member.

2. The movable separable connector module of claim 1 in which said contact rod is fully installed by applying a prescribed torque to said contact rod after said shoulder engages said surface of said connector member.

3. The movable separable connector module of claim 1 in which said passage extends transversely of the longitudinal axis of said hole.

4. The movable separable connector module of claim 1 in which said passage extends generally parallel to the longitudinal axis of said hole.

5. The movable separable electrical connector module of claim 1 in which said module is an elbow and said hole in the connector member is located closely adjacent one end of the connector member.

6. The movable separable connector module of claim 5 in which said passage is substantially perpendicular to the axis of said hole and is located on the opposite side of said hole from said one end of the connector member.

7. The movable separable connector module of claim 5 in which said passage is generally parallel to the longitudinal axis of said hole and is located on the opposite side of said hole from said one end of the connector member.

8. A separable electrical connector module movable through an operating stroke and adapted to couple with a mating connector module, comprising:

(a) a connector member comprising a copper portion containing a hole having a central longitudinal axis and internal threads surrounding said axis, (b) a copper contact rod having one end that is externally threaded to provide external threads that mate with said internal threads to form a current-carrying threaded joint between said contact rod and said connector member and an opposite end adapted to engage a contact within said mating module, and (c) means for enhancing the current-carrying capabilities of said threaded joint and for restraining said external threads against rotation with respect to said internal threads comprising:

a passage in said connector member portion that intersects said internal threads in a predetermined location at one side of said central longitudinal axis, and a pin of plastic material tightly fitting within said passage and bearing against the external threads of said contact rod to provide a radial force on said contact rod that urges the external threads of said contact rod into high pressure engagement with said internal threads at the opposite side of said longitudinal axis from said predetermined location, thus maintaining a good electrical connection between the threads of said contact rod and said connector member despite repeated motion of said movable separable connector module through its operating stroke, and in which:

(d) said passage extends generally parallel to the longitudinal axis of said hole.

9. The movable separable module of claim 8 in which:

(a) said module is an elbow and said hole in the connector member is located closely adjacent one end of the connector member, and (b) said passage is located on the opposite side of said hole from said one end of the connector member.

* * * * *